US005163452A

United States Patent [19]

Marritt et al.

[11] Patent Number: 5,163,452

[45] Date of Patent: Nov. 17, 1992

[54] ROD MAKING APPARATUS FOR USE IN THE MANUFACTURE OF SMOKING ARTICLES

[75] Inventors: Clifford R. Marritt; James W. Pryor; Philip A. Deal, all of Winston-Salem, N.C.

[73] Assignee: R. J. Reynolds Tobacco Company, Winston-Salem, N.C.

[21] Appl. No.: 855,733

[22] Filed: Mar. 19, 1992

Related U.S. Application Data

[63] Continuation of Ser. No. 585,444, Sep. 20, 1990, abandoned.

[51] Int. Cl.[5] ..... A24D 3/00

[52] U.S. Cl. ..... 131/84.1; 131/84.2; 131/331; 493/42; 493/44

[58] Field of Search ..... 131/84.1, 84.2, 345, 131/335, 359, 331; 493/39, 42, 44, 46

[56] References Cited

U.S. PATENT DOCUMENTS 3,033,211 10/1959 Godfrey .
3,371,000 2/1968 Davenport et al. .
3,584,630 6/1971 Innskeep .
4,186,754 2/1980 Labbe .
4,409,995 10/1983 Nichols .
4,549,875 10/1985 Pryor .
4,619,276 10/1986 Albertson et al. .
4,676,259 6/1987 Ellis et al. .
4,800,903 1/1989 Ray et al. .
4,807,809 2/1989 Pryor et al. .
4,850,301 7/1989 Greene, Jr. et al. .
4,862,905 9/1989 Green, Jr. et al. .
4,893,637 1/1990 Hancock et al. .
4,899,765 2/1990 Davis et al. .

*Primary Examiner*—Vincent Millin
*Assistant Examiner*—J. Doyle
*Attorney, Agent, or Firm*—Bell, Seltzer, Park and Gibson

[57] ABSTRACT

Rods for use in the manufacture of smoking products are provided using a rod-making apparatus. The apparatus includes (a) an unwind unit for continuously supplying a material having a continuous integrity; (b) a rod-forming unit for forming a rod-like composite of the supplied material; (c) a constriction member for constricting the rod-like composite, the constriction member including (i) a material-contacting surface and (ii) a reservoir for supplying an amount of liquid to at least a portion of the material-contacting surface; and (d) a rod-making unit for receiving the rod-like composite and for circumscribing the rod-like composite with wrapping material thereby forming a continuous rod.

18 Claims, 2 Drawing Sheets

ROD MAKING APPARATUS FOR USE IN THE MANUFACTURE OF SMOKING ARTICLES

This application is a continuation of pending prior application Ser. No. 07/585,444, filed Sep. 20, 1990, now abandoned.

BACKGROUND OF THE INVENTION

The present invention relates to the manufacture of rods for use in the manufacture of smoking articles, and in particular to the manufacture of filter rods for cigarette manufacture.

Popular smoking articles, such as cigarettes have a substantially cylindrical rod shaped structure and include a charge of smokable material such as shredded tobacco (e.g., cut filler) surrounded by a paper wrapper, thereby forming a so-called "tobacco rod." It has become desirable to manufacture cigarettes having a cylindrical filter element aligned in an end-to-end relationship with the tobacco rod. Typically, a filter element includes cellulose acetate tow or other material having a continuous integrity circumscribed by plug wrap, and is attached to the tobacco rod using a circumscribing tipping material. Cigarette filter elements are provided by subdividing a filter rod at regular, predetermined intervals. Various types of cigarette filter rod apparatus are known such as described in U.S. Pat. Nos. 4,807,809 to Pryor et al and 4,862,905 to Greene, Jr. et al.

During the manufacture of filter rods using a conventional filter rod-making apparatus, a stream of filter material having a continuous integrity is formed into a rod-like composite and compressed by a constriction member. An exemplary constriction member commonly is known in the art as a "tongue". Should the filter making machine be running at a high rate of speed there is a tendency for frictional forces to build-up on the constriction member particularly due to the accumulation of a gum-like substance on its inner surface. This is sometimes a problem when the rod material has been treated with a smoke-modifying agent (e.g., flavorants, tobacco extracts and the like) such as described in U.S. Pat. Nos. 4,549,875 to Pryor and 4,850,301 to Greene Jr. et al and U.S. Ser. No. 414,835 filed on Sep. 29, 1989. The increase in frictional forces and accumulation of the gum-like substance reduce the efficiency of the machine, and also the uniformity and quality of the rods produced.

Various references have proposed introducing substances in the tongue region of a tobacco rod making apparatus as a stream of a plurality of individual pieces of shreds or strands of tobacco material (i.e., a "tobacco filler material") is formed into a tobacco rod. For example, U.S. Pat. No. 4,186,754 to Labbe proposes feeding water or alcohol to the surface of the tongue which contacts the stream of a particular type of tobacco in order to dilute and reduce the viscosity of gum which reportedly builds up on the tongue. U.S. Pat. No. 4,409,995 to Nichols proposes applying flavorant in particulate or liquid form to a cigarette rod through the tongue region of a tobacco rod making apparatus. U.S. Pat. No. 4,619,276 to Albertson et al proposes applying flavorant in foam form through the tongue region of a tobacco rod making apparatus. U.S. Pat. No. 4,899,765 to Davis et al proposes the application of a liquid fluid to tobacco filler material while in the tongue region of a tobacco rod making apparatus which allows a manufacturer to produce a cigarette rod of controlled integrity.

It would be highly desirable to provide an apparatus for manufacturing filter rods for smoking articles of highly consistent quality and at high speeds.

SUMMARY OF THE INVENTION

The present invention relates to an apparatus for preparing rods (e.g., filter rods) of highly consistent quality, in particular at relatively high speeds (i.e., at speeds in excess of 2000 rods of about interest is the efficient and effective preparation of rods formed from a material having a continuous integrity treated with, coated with or otherwise incorporating a smoke-modifying agent such as a flavoring agent, tobacco extract or the like.

More particularly, the present invention relates to an apparatus for manufacturing rods for use in the manufacture of smoking articles particularly filter rods. The apparatus includes (a) means for continuously supplying a material having a continuous integrity; (b) means for forming a rod-like composite from the supplied material; (c) means for constricting the material into a rod-like composite, the means including (i) a material-contacting surface and (ii) means for supplying an amount of liquid to at least a portion of the material-contacting surface; and (d) rod-making means for receiving the rod-like composite and for circumscribing the rod-like composite with wrapping material thereby forming a continuous rod. The apparatus most preferably includes means for subdividing the continuous rods into a plurality of rods. In another aspect, the invention relates to method of manufacturing rods. The method comprises (a) continuously supplying a material having a continuous integrity; (b) forming a rod-like composite from the supplied material; (c) constricting the rod-like composite by contacting the material with a material-contacting surface; (d) supplying an amount of liquid to at least a portion of the material-contacting surface; and (e) forming a continuous rod from the rod-like composite by circumscribing the rod-like composite with wrapping material. The method most preferably includes subdividing the continuous rod into a plurality of rods.

As used herein, the term "material having a continuous integrity" in referring to the material used for the manufacture of rods, the overall nature of which is maintained in a unitary, uninterrupted fashion or condition as the material, is continuously supplied for rod making. Such a material typically is a filter material for the manufacture of filter rods. The material can be an entangled collection of fibers (e.g., in non-woven form) in the form of a web of the material, and the web can have a continuous, undivided sheet-like configuration. As used herein, by the term "sheet-like" is meant that the filter material of continuous integrity is in a configuration or form wherein the width and length thereof are substantially greater than the thickness thereof. By the term "web" is meant that the material is in a configuration or form wherein the longitudinally extending length thereof is substantially greater than the width thereof. Thus the term "material having a continuous integrity" includes a web of filter material normally in sheet-like configuration, and having an uninterrupted and undivided continuous nature, but does not include a material having a discontinuous nature, such as a blend of divided and separate strands or shreds of tobacco (i.e., "tobacco cut filler") used in forming a cigarette tobacco rod.

One preferred means for forming the rod-like composite can include means for pleating the material particularly when the material is in the form of a web of sheet-like filter material fed from a bobbin. Preferably the means for pleating includes a frustoconical tube and a frustoconical member positioned within the frustoconical tube. The inner frustoconical member is concentric to and is positioned coaxially with respect to the frustoconical tube. In such a manner, an annular region is formed between the outer surface of the frustoconical member and the inner surface of the frustoconical tube. Such a means for pleating is described in U.S. Pat. No. 4,870,809 to Pryor et al, herein incorporated by reference.

The apparatus and method of the present invention provide for the efficient and effective manufacture of rods from material having a continuous integrity, and particularly a material for the manufacture of filter rods which incorporates a smoke-modifying agent. For example, the present invention can be used to manufacture filter rods from a hydrophobic non-woven web of polypropylene fibers in sheet-like form which carries a relatively high level of a tobacco extract such as described in U.S. Ser. No. 414,835, filed on Sep. 29, 1989, herein incorporated by reference. The present invention permits this and other materials to be processed at high speeds. These high speeds are possible by the avoidance of the typical tendency of the extract to deposit and build-up a gum-like substance on the constriction member or tongue portion of the apparatus due to the sticky character of the extract.

DETAILED DESCRIPTION OF THE PREFERRED EMBODIMENTS

Figure 1:
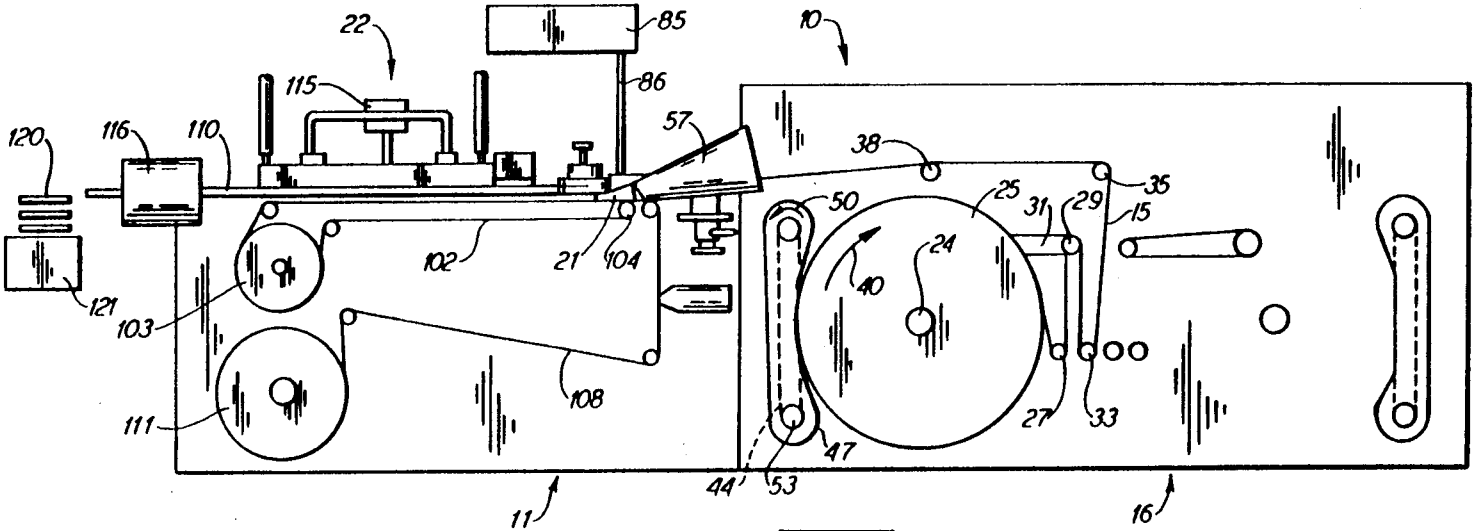
FIG. 1 is a schematic representation of an exemplary apparatus for manufacturing certain rods in accordance with one aspect of the present invention.

Referring to FIG. 1, a rod-making apparatus is shown. The rod-making apparatus includes a rod-forming unit 11 or other means for forming a rod-like composite from a material 15 having a continuous integrity continuously supplied from an unwind unit 16 or other means for continuously supplying or otherwise providing material 15. The thusly formed rod-like composite is constricted by a constriction member 21 otherwise called a tongue. The rod-like composite is then formed into a continuous rod by a rod-making means or other means for forming a continuous rod. An exemplary rod-making apparatus 10 is a commercially available KDF-2 from Hauni-Werke Korbe & Co., Kg., Hamburg Fed. Rep. of West Germany. The manner of operation of a suitable rod-making apparatus is known by the skilled artisan.

The material 15 is typically a filter material for use in the manufacture of filter rods, and can be in the form of a non-woven web of a synthetic fiber such as polypropylene fibers, a filamentary tow such as cellulose acetate tow, or the like. For example, if cellulose acetate tow is used as the filter material, conventional filamentary tow processing units such as a commercially available E-60 supplied by Arjay Equipment Corp., Winston-Salem, N.C. and described in U.S. Pat. No. 4,862,905 to Greene, Jr. et al can be used.

If a non-woven web of synthetic fibers is used as the material 15, a processing unit shown in FIG. 1 and described in U.S. Pat. No. 4,807,809 to Pryor et al can be used. The unwind unit 16 for providing the material 15 includes a rotatable mandrel 24 for supporting bobbin 25. The mandrel 24 includes a chuck or other such means for gripping the internal hollow core of the bobbin 25. The material 15 preferably in the form of a web is continuously fed from the bobbin 25 around fixed guide roller 27 and around dancer roller 29. The dancer roller 29 is carried by a movable arm 31 thereby forming a dancer unit such that material 15 can be fed from the bobbin 25 and obtained at a relatively constant, controlled tension. The material 20 passes from the dancer roller 29 around fixed guide roller 33, around another fixed guide roller 35, and over yet another guide roller 38. It is convenient for guide roller 38 to be an adjustable guide roller. The material 20 then passes into the rod-making unit 22. The combination of the mandrel 24, dancer roller 29 and guide rollers 27, 33, 35, and 39 provides a control means for providing material at a controlled tension. Other configurations of dancer rollers and guide rollers may be apparent to the skilled artisan.

Mandrel 24 allows the bobbin 25 to be rotated such as in the direction shown by arrow 40. The rotation is provided by movement of belt 44 (shown by broken lines) on drive arm 47 which supports the belt. The belt 44 moves in the direction shown by arrow 50 as a result of rotation of gear 53. Gear 53 is driven at a rate which is timed to the rate at which the drive means of the rod-making unit operates. A suitable method for controlling the rate of the feed of the material relative to the speed of operation of the rod-making unit is described in U.S. Pat. No. 4,807,809 to Pryor et al. Other suitable methods will be apparent to the skilled artisan.

A typical rod-forming unit 11 such as described in U.S. Pat. No. 4,807,809 to Pryor et al includes an outer frustoconical tube 57 having a narrow region of about 16 mm minimum inner diameter, an entrance region of about 242 mm maximum inner diameter, and an axial length of about 313 mm; and a frustoconical inner member similar to the outer tube having a narrow region of about 18 mm minimum outer diameter, an entrance region of about 229 mm maximum outer diameter, and an axial length of 318 mm. Such an outer tube and inner member can be arranged concentrically and the inner member coaxially with the outer tube such that the annular region therebetween has a width (e.g., a radial width) of 1 mm to 10 mm, preferably about 3 mm. The material tends to become pleated as the circumference of the inner member decreases. Typically, webs of material of 6 inch to 15 inch, preferably 8 inch to 12 inch width conveniently can be processed into a rod-like composite.

Figure 3:
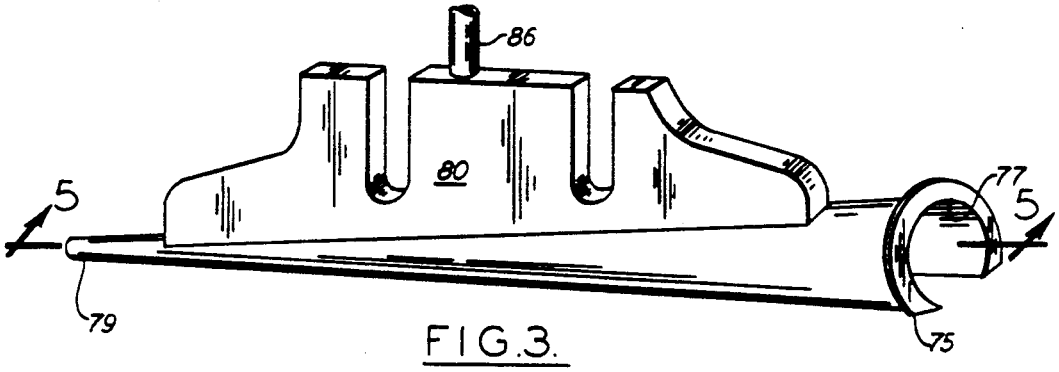
FIG. 3 is a projectional view of an exemplary constriction member in accordance with one aspect of the invention.
Figure 4:
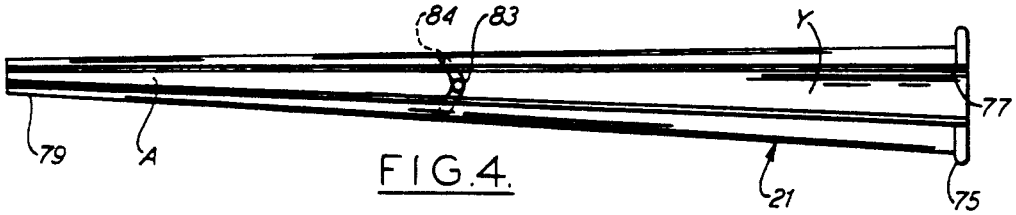
FIG. 4 is a bottom plan view of the exemplary constriction member in accordance with one aspect of the invention.
Figure 5:
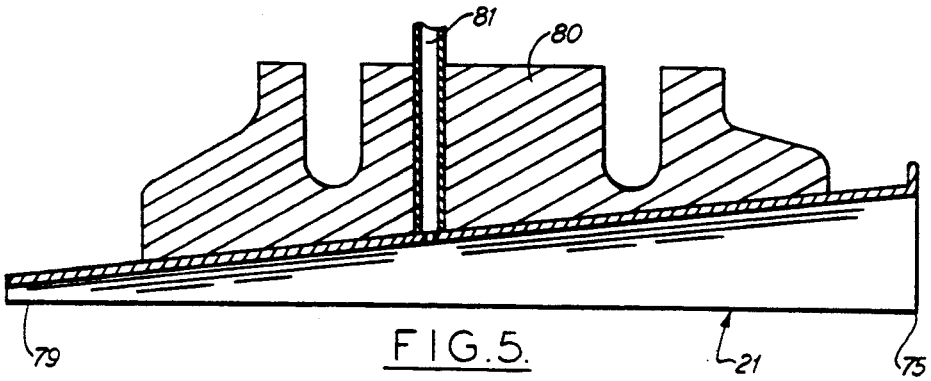
FIG. 5 is a cross-sectional view of the exemplary constriction member taken substantially along line 5—5 of FIG. 1.

The narrow exit region of the frustoconical tube 57 of the rod-forming unit 11 is positioned relative to constriction member 21 (i.e., "the tongue") or other such means for constricting the rod-like composite. An exemplary constriction member is tongue, Part No. HPM-132-DF-114-F available from Hauni-Werke Korber & Co., KG. or the modified tongue described in U.S. Pat. No. 4,893,637 to Hancock et al, herein incorporated by reference. Referring to FIGS. 3-5, the constriction member 21 preferably has an open, funnel or trumpet-like inlet end 75 that is wide enough to receive the full width of the material 15 being used. The curved or arcuate material-contacting surface 77 of the constriction member 21 tapers inwardly from the inlet end 75 to an exit end 79 through which the constricted rod-like composite exits and is received by the rod-making means 22. The constriction member 21 is maintained in place by a cantilever beam member 80. Preferably, the constriction member defines a passageway having a generally decreasing cross-sectional area from the entrance end to the exit end. For example, the inlet end 75 is about one inch inside diameter which tapers down to about 11/32 inch inside diameter at the exit end 79. Alternatively, the constriction member 21 can be a two-piece construction (not shown) such that the inlet end 75 is positioned in a first tapered section and the exit end 79 is positioned in a second tapered section of lesser length or a so-called "short-tongue."

Frictional forces tend to build-up on the material-contacting surface 77 as the overall speed of the rod-making apparatus 10 is increased to speeds greater than 2000 rods/min and even to greater than 4000 rods/min. These forces increase inasmuch as gum-like substances from the material tend to deposit and build-up on the surface 77 typically at point A as shown in FIG. 4. This is particularly a problem if the material carries a relatively high level (e.g., up to about 55 weight percent) of a smoke-modifying agent (e.g., flavoring agents, plasticizing agents, tobacco extracts, etc.) describe, for example, in U.S. Pat. No. 4,549,875 to Pryor, in U.S. Ser. No. 414,835 filed on Sep. 29, 1989, or in U.S. Ser. No. 518,597, filed on May 3, 1990, all herein incorporated by reference. One preferred material 15 can be in the form of a web of non-woven thermoplastic and hydrophobic fibers which is in intimate contact with and carries a water soluble and hydrophilic tobacco extract to provide an extract-containing filter material. A highly preferred web of thermoplastic fibers is a non-woven web of polypropylene fibers available as PP200 SD from Kimberly-Clark Corporation. Water soluble tobacco extracts are provided by extracting a tobacco material with a solvent having an aqueous character (i.e., a solvent consisting primarily of water, preferably greater than 90 weight percent water, and most preferably essentially pure water). Typically, extract-containing filter materials include about 5 to 55, preferably about 10 to about 30 weight percent tobacco extract and optionally a minor amount of a lubricating substance such as a polyhydric alcohol.

The build-up of friction can be reduced by introducing a liquid fluid into the constriction member through a vertical bore or passageway 81 (see FIG. 5) through associated horizontal passageway (not shown), and in turn through one or more associated liquid outlet openings 83 (see FIG. 4). It is preferable that the liquid outlet openings be positioned towards the entry end 77 of the constriction member 21 close to point Y upstream from where the frictional forces are the greatest and upstream from where a gum-like substance builds-up due to the sticky character of the extract.

The liquid outlet openings 83 can vary in number, shape and positioning. For example, referring to FIG. 4, the liquid outlet opening 83 can be a single opening toward the downstream end of the constriction member 21, or the outlet openings can be one or more outlet openings positioned longitudinally along the material-contacting surface of the constriction member such as at points A and Y. The cross-sectional shape of the outlet openings can be circular, oval, or the like. For example, outlet openings having a circular cross-sectional shape often can have diameters which range from about 0.25 mm to about 1.5 mm. The outlet openings most desirably are positioned at an angle less than 90° relative to the surface of the material stream so as to minimize the possibility of clogging the openings. It also is possible to employ grooves 84 or channels which extend generally along the longitude of the material-contacting surface of the constriction member from each opening in order to promote a dispersion of the liquid across the entire material-contacting surface of the constriction member. Preferably, the liquid outlet openings are positioned within the upstream half, more preferably the upstream third, of the longitudinal length of the material-contacting surface of the constriction member.

The liquid fluid used in the process of the present invention is one which maintains the material-contacting surface 77 free of build-up due to the material and allows the filter material to pass therethrough in an efficient manner while reducing friction. Preferably, the liquid is an aqueous liquid, and most typically is essentially pure water. The liquid also can be an alcohol such as methanol, ethanol, isopropanol, etc., a polyhydric alcohol such as glycerin, propylene glycol, etc., or the like. Mixtures of miscible liquids or liquids having compatible solubilities can be employed. Additives such as surfactants and flavorants can be incorporated into the liquid, if desired. Additionally if the material is treated with a smoke-modifying agent, the liquid preferably is a liquid in which the smoke-modifying agent is soluble.

The amount of liquid employed can vary and it is applied in a controlled amount. For example, when water is used, about 2 ml/min to about 20 ml/min, preferably about 4 ml/min to about 16 ml/min thereof is passed through the constriction member for a filter making machine operating so as to manufacture a continuous rod at a rate between about 100 m/min and about 400 m/min Typically, the amount of liquid passed through the constriction member increases as the rate of rod manufacture increases. For example, when a continuous rod is manufactured at a rate greater than about 200 m/min, it is preferable to feed an aqueous liquid through the constriction member at a rate greater than about 7 ml/min. The amount of liquid passing through the constriction member also can vary depending upon the composition of the material which is employed to manufacture the rod. For very high speed rod manufacture rates, the optimum liquid delivery rate through the constriction member can be determined by experimentation.

Figure 2:
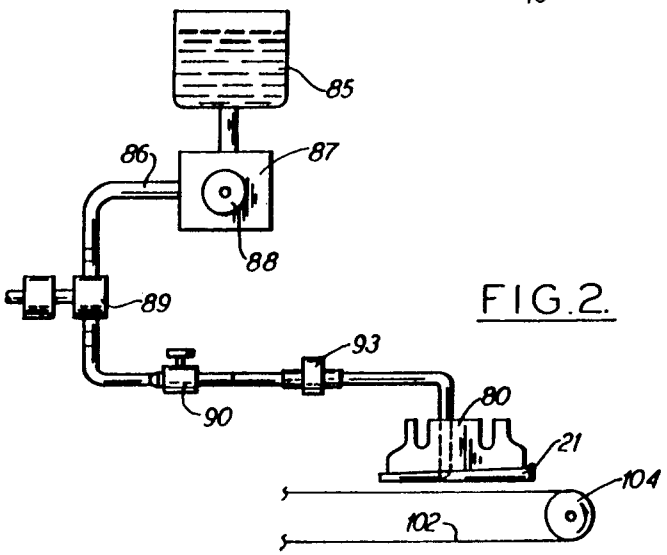
FIG. 2 is an exploded schematic representation of an exemplary means for supplying a liquid in accordance with one aspect of the present invention.

Referring to FIG. 2, the liquid is supplied from a reservoir tank 85 or other means for supplying the liquid and provides a flow of the liquid to at least a portion of the material-contacting surface of the constriction member 21 by way of a series of tubes 86 and pumping mechanism 87. The pumping mechanism provides for a positive flow of liquid through the constriction member in the desired predetermined amount during the rod formation process. A low volume positive displacement piston pump is a particularly preferred pumping mechanism. A pumping mechanism timed to the drive shaft (not shown) of the rod making machine using a timing belt mechanism and pulley 88 can ensure that the desired predetermined amount of liquid flows through the constriction member 21 at a particular rod formation speed.

If desired, a three-way valve 89, a quick disconnect member 90 and a filter element 93 can be employed. The three-way valve 89 can be of the type commercially available as No. X53LB1100 from Skinner Valve Division of Honeywell, Inc. New Britain, Conn.; and provides for a recyclization of liquid pumped from the reservoir 85 by the pumping mechanism 87 prior to the time that the continuous rod is manufactured at a speed great enough to require the introduction of liquid through the constriction member 21. The use of the three-way valve 89 is particularly useful during start-up and shut-down periods of rod manufacture. The quick disconnect member 90 is a combination of part numbers MCD 10-02 and MCD 20-04 from Genoa Corporation, St. Paul, Minn., and is employed for convenient servicing of the rod-making machine. The filter element 93 can be a 15 micron filter such as is available as SS-4FW-15 from Nupro Company, Willoughby, Ohio. The filter element can act to prevent blockage of the passageways which extend through the constriction member as well as dampen any surges or pulses in the liquid flow which passes to the constriction member.

The material which exits the constriction member 21 is received by the rod-making means 22 which includes a wrapping mechanism 100 and an endless garniture conveyor belt 102. The endless garniture conveyor belt is continuously and longitudinally advanced using advancing mechanism 103. Roller 104 provides a means for guiding the garniture conveyor belt under the constriction member 21 of the rod forming unit. The wrapping mechanism introduces a web of wrapping material 108 to the outer surface of the cylindrical rod-like composite to circumscribe the composite and to produce a continuous rod 110. Typically, the web of wrapping material is provided from bobbin 111. Roller 113 provides a means for guiding the web of wrapping material into the garniture. The wrapping material is secured or sealed using sealing means 115. The continuous rod passes from the sealing means 115 and is subdivided (e.g., severed) at regular intervals at the desired predetermined lengths using cutting means 116. The plurality of rods 120 are collected for use in collection means 121 such as a tray, collection drum or the like.

Alternatively, the rod can be axially aligned in an end-to-end relationship, preferably abutting a second rod or segment similarly overwrapped with wrap material such as described in U.S. Ser. No. 414,835, filed on Sep. 29, 1989. The rods can be provided in the described alignment using plug tube combination machinery, the operation of which is known to the skilled artisan.

Thus, in operation, the material 15 having a continuous integrity is supplied and formed into a rod-like composite. The rod-like composite is constricted by contacting the material of the rod-like composite with a material-contacting surface 77. While the contacting is occurring, an amount of liquid is supplied to at least a portion of the material-contacting surface. The rod-like composite is then formed into a continuous rod by circumscribing the rod-like composite with wrapping material. The continuous rod can be subdivided into a plurality of rods.

The following examples are provided in order to further illustrate the invention but should not be construed as limiting the scope thereof. Unless otherwise noted, all parts and percentages are by weight.

EXAMPLE 1

A previously described KDF-2 filter making machine is equipped with a constriction member of the type shown in FIGS. 3–5. The constriction member is mounted using a cantilever beam member in a conventional manner. The constriction member is machined from Hauni-Werke Korber & Co., KG., Part No. HPM-132-DF-114-F.

As shown in FIGS. 3–5, the constriction member includes a vertical passageway having an outer diameter of about 6.3 mm and an inner diameter of about 5 mm which extends to about 1.6 mm from the constriction member and communicates with a 0.8 mm opening in the constriction member as shown in FIG. 5. Tap water at about 22° C. is fed from a reservoir through Poly-Flo tubing of 3.18 mm inner diameter through a RH1CKC positive displacement pump manufactured by Fluid Metering, Inc., Oyster Bay, N.Y., and through Poly-Flo tubing and into the constriction member. The flow rate of water through the constriction member is controlled as the pump is timed with the drive shaft of the rod making machine.

A filter material comprises a web of non-woven polypropylene pleated using the rod-forming apparatus described in U.S. Pat. No. 4,807,809 to Pryor et al. The web has a width of 11.75 inches, a basis weight of about 0.7 oz/yd$^2$, and is available as PP220 SD from Kimberly-Clark Corp. The web so described has applied thereto a water soluble tobacco extract and glycerin. The extract and glycerin are applied to the web using a rotogravure process. In particular, a spray dried aqueous Burley tobacco extract and glycerin are dissolved in water, applied to the web using a rotogravure process, and the resulting wet web is dried to provide a tobacco extract and glycerin in intimate contact with the non-woven polypropylene web. The resulting web comprises about 70 percent polypropylene, about 28 percent tobacco extract and about 2 percent glycerin.

A continuous rod is manufactured from the filter material and cut into lengths of about 96 mm in excess of 2000 rods/min. Water is fed through the constriction member at a rate of about 7 ml/min when about 2000 rods/min are manufactured. Moreover, the measured temperature at the material-contacting surface is less than 50° C. as compared to about 80° C. when no water is fed. When water is not fed through the constriction member, the extract tends to deposit and build-up on the constriction member as a gum-like substance due to the sticky character of the extract, and within about 1 minute the machine must be stopped.

EXAMPLE 2

Example 1 was repeated except that a mixture of 50 parts tap water and 50 parts glycerin is fed from the reservoir. When this liquid fluid mixture is used, the flow rate can be reduced to about 3.5 ml/min while manufacturing about 2000 rods/min.

That which is claimed is:

1. An apparatus for manufacturing rods for use in the manufacture of smoking articles, the apparatus including:

(a) means for continuously supplying a material having a continuous integrity;

(b) means for forming a rod-like composite from the material;

(c) means for constricting the rod-like composite, said means including (i) a material-contacting surface and (ii) means for supplying an amount of liquid to at least a portion of the contacting surface through at least one liquid outlet opening in the contacting surface and (d) rod-making means for receiving the rod-like composite with wrapping material thereby forming a continuous rod.

2. An apparatus according to claim 1 including means for subdividing the continuous rod into a plurality of rods.

3. An apparatus according to claim 2 wherein the means for constricting includes at least one groove along the longitude of the material-contacting surface thereof.

4. An apparatus according to claim 2 including means for axially aligning one of the plurality of rods in an end-to-end relationship with a second rod and maintaining the rods in place.

5. An apparatus according to claim 1 or 2 wherein the means for continuously supplying a material having a continuous integrity includes a bobbin of wet of the material in sheet-like form and the means for forming includes means for pleating the material which includes a frustoconical tube and a frustoconical member concentric to the tube and positioned with respect to the tube such that (i) an annular region is formed between the outer surface of the frustoconical tube, and (ii) the material is fed through the annular region so as contact the outer surface of the frustoconical member.

6. An apparatus according to claim 1 or 2 wherein the means for supplying a controlled amount of liquid includes means for providing a predetermined amount of liquid to the material.

7. An apparatus according to claim 5 wherein the liquid is water and the predetermined amount supplied by the means for supplying is from about 2 ml/min to about 20 ml/min.

8. A method of manufacturing rods for use in the manufacture of smoking articles, the method comprising:

(a) continuously supplying a material having a continuous integrity;

(b) forming a rod-like composite from the supplied material;

(c) constricting the rod-like composite by contacting the material with a material-contacting surface;

(d) supplying amount of liquid to at least a portion of the material-contacting surface through at least one liquid outlet opening in the contacting surface and (e) forming a continuous rod from the rod-like composite by circumscribing the rod-like composite with wrapping material.

9. A method according to claim 8 whereby the step of supplying an amount of liquid of step (d) includes dispersing the liquid across substantially the entire material-contacting surface.

10. A method according to claim 8 including the step of subdividing the continuous rod into a plurality of rods.

11. A method according to claim 10 including the step of axially aligning one of the plurality of rods with a second rod and maintaining the rods in place.

12. A method according to claim 8 whereby the amount of liquid supplied in step (C) is from about 2 ml/min to about 20 ml/min.

13. A method according to claim 8 whereby the material having a continuous integrity includes a hydrophobic web of polypropylene fibers carrying a tobacco extract.

14. An apparatus for manufacturing rods for use in the manufacture of smoking articles, the apparatus including:

(a) means for continuously supplying a material having a continuous integrity;

(b) means for forming rod-like composite from the material;

(c) means for constricting the rod-like composite, said means including (i) a material-contacting surface and (ii) means for supplying a liquid directly to at least a portion of the contacting surface through at least one liquid outlet opening in the contacting surface, said opening positioned so as to permit the supplied liquid to reduce the build-up of friction between the contacting surface and the material having a continuous integrity, and (iii) at least one groove along the longitude of the matrail-contacting surface thereof; and (d) rod-making means for receiving the rod-like composite with wrapping material thereby forming a continuous rod.

15. An apparatus according to claim 14, including means for subdividing the continuous rod into a plurality of rods.

16. An apparatus according to claim 14 including means for axially aligning one of the plurality of rods in an end-to-end relationship with a second rod and maintaining the rods in place.

17. An apparatus according to claim 14 or 15 wherein the means for supplying includes a bobbin of web of the material in sheet-like form and the means for forming includes means for pleating the material which includes a frustoconical tube and frustoconical member concentric to the tube and positioned with respect to the tube such that (i) an annular region is formed between the outer surface of the frustoconical tube, and (ii) the material is fed through the annular region so as contact the outer surface of the frustoconical member.

18. An apparatus according to claim 14 or 15 wherein the means for supplying a controlled amount of liquid includes means for providing a predetermined amount of liquid to the material.

* * * * *

UNITED STATES PATENT AND TRADEMARK OFFICE

CERTIFICATE OF CORRECTION

PATENT NO. : 5,163,452

DATED : November 17, 1992

INVENTOR(S) : Clifford R. Marritt et al.

It is certified that error appears in the above—identified patent and that said Letters Patent is hereby corrected as shown below:

Col. 2, line 11, after "about", insert --100 to 120 mm in length per minute). Of particular--.

Col. 4, line 26, "3$," should be --35,--.

Col. 4, line 31, "39" should be --38--.

In the Claims:

Col. 10, line 10, "(C)" should be --(d)--.

Col. 10, line 32, "matrail" should be --material--.

Signed and Sealed this

Fourth Day of January, 1994

Bruce Lehman

*Attest:*

BRUCE LEHMAN

*Attesting Officer*

*Commissioner of Patents and Trademarks*